US011274495B2

(12) United States Patent
Garay

(10) Patent No.: US 11,274,495 B2
(45) Date of Patent: Mar. 15, 2022

(54) LADDER STEP ATTACHMENT

(71) Applicant: Felipe Garay, Alvarado, TX (US)

(72) Inventor: Felipe Garay, Alvarado, TX (US)

( * ) Notice: Subject to any disclaimer, the term of this patent is extended or adjusted under 35 U.S.C. 154(b) by 243 days.

(21) Appl. No.: 16/413,772

(22) Filed: May 16, 2019

(65) Prior Publication Data

US 2019/0352965 A1 Nov. 21, 2019

Related U.S. Application Data

(60) Provisional application No. 62/672,721, filed on May 17, 2018.

(51) Int. Cl.
*E06C 7/16* (2006.01)

(52) U.S. Cl.
CPC ..... *E06C 7/165* (2013.01)

(58) Field of Classification Search
CPC ..... E06C 7/165; A01M 31/02
See application file for complete search history.

(56) References Cited

U.S. PATENT DOCUMENTS 248,014 A * 10/1881 Boardman ..... E06C 7/165 182/120
335,051 A * 1/1886 Ayers ..... E06C 7/165 182/120
606,763 A * 7/1898 Lukens ..... E06C 7/16 248/238
806,162 A * 12/1905 Milbradt ..... E06C 9/12 182/120
897,929 A * 9/1908 Ridout ..... E06C 7/165 182/120
1,454,750 A * 5/1923 George ..... E06C 7/165 182/103
1,615,135 A * 1/1927 Putnam ..... E06C 1/38 182/120
2,665,952 A * 1/1954 Edwards ..... E06C 7/16 182/122
2,726,901 A * 12/1955 Newman ..... E06C 7/081 182/120
2,730,412 A * 1/1956 Yoder ..... E06C 1/38 182/120
2,871,067 A * 1/1959 Brogdon ..... E06C 7/16 182/121
2,899,011 A * 8/1959 Babits ..... E06C 7/165 182/228.3
3,115,214 A * 12/1963 Roberts ..... E06C 7/165 182/228.3

(Continued)

*Primary Examiner* — Colleen M Chavchavadze
(74) *Attorney, Agent, or Firm* — Boudwin Intellectual Property; Daniel Boudwin

(57) ABSTRACT

A ladder step attachment. The ladder step attachment includes a base having a pair of arms extending away from an upper surface thereof. The pair of arms extend at an angle such that a distal end of the pair of arms is closer to a rear side of the base than to a front side of the base. A fastener is located on the distal end, wherein the fastener can removably secure to a rung of a ladder. The base further includes a cutout along the front side, wherein a platform is secured to the base at a lateral side of the cutout via a hinge. The platform can move between an open position and a closed position, wherein the platform is coplanar with the base when in the closed position.

9 Claims, 3 Drawing Sheets

(56) References Cited

U.S. PATENT DOCUMENTS

| | | | | | |
|---|---|---|---|---|---|
| 3,422,923 | A * | 1/1969 | Lund | E06C 7/14 | 182/120 |
| 4,401,187 | A * | 8/1983 | Van Patten | E06C 7/143 | 182/121 |
| 4,437,544 | A * | 3/1984 | Anderson | E06C 7/165 | 182/120 |
| 4,972,923 | A * | 11/1990 | Krause | E06C 7/16 | 182/121 |
| 5,779,208 | A * | 7/1998 | McGraw | E06C 7/165 | 182/120 |
| 5,927,435 | A * | 7/1999 | Benton | A01M 31/02 | 182/116 |
| 5,975,240 | A * | 11/1999 | O'Brien | E06C 7/165 | 182/116 |
| 6,786,300 | B1 | 9/2004 | Bonifacini | | |
| 7,861,826 | B2 * | 1/2011 | Meyers | E06C 7/16 | 182/121 |
| 8,042,652 | B2 * | 10/2011 | Weir | A01M 31/02 | 182/116 |
| 8,657,070 | B2 | 2/2014 | O'Brien et al. | | |
| 9,677,336 | B2 | 6/2017 | Najey | | |
| 9,890,589 | B2 | 2/2018 | Goodnow et al. | | |
| 10,738,533 | B2 * | 8/2020 | Weyrauch | E06C 7/50 | |
| 2004/0163890 | A1 | 8/2004 | Nash | | |
| 2007/0256892 | A1 * | 11/2007 | Breedlove | E06C 1/381 | 182/116 |
| 2015/0361722 | A1 * | 12/2015 | Chick | A01M 31/02 | 182/113 |

* cited by examiner

LADDER STEP ATTACHMENT

CROSS REFERENCE TO RELATED APPLICATIONS

This application claims the benefit of U.S. Provisional Application No. 62/672,721 filed on May 17, 2018. The above identified patent application is herein incorporated by reference in its entirety to provide continuity of disclosure.

BACKGROUND OF THE INVENTION

The present invention relates to ladder step attachments. More particularly, the present invention pertains to ladder step attachments having a hinged platform within the base, allowing a user to climb through the step attachment without first removing the step attachment.

Many individuals use ladders to perform various tasks, such as cleaning a roof, painting a wall, or the like. During these tasks, it is often desirable to have a greater range of movement than typically provided with a traditional ladder, thereby allowing the user to more effectively maneuver to perform the task. Generally, step extension attachments can provide such a greater range of motion, however these attachments must be removed before a user can climb or descend the ladder past the attachment. This can be difficult to do, and often risks injury as a user can lose their balance and fall from the ladder. Therefore, there is a need for a ladder attachment that provides a user with a greater range of movement about a ladder rung, while allowing a user to climb or descend the ladder without being forced to remove the attachment.

In light of the devices disclosed in the known art, it is submitted that the present invention substantially diverges in design elements from the known art and consequently it is clear that there is a need in the art for an improvement to existing ladder step attachments. In this regard, the instant invention substantially fulfills these needs.

SUMMARY OF THE INVENTION

In view of the foregoing disadvantages inherent in the known types of ladder step attachments now present in the known art, the present invention provides a ladder step attachment wherein the same can be utilized for providing convenience for the user when climbing or descending a ladder without needing to first remove the step attachment.

The present system comprises a base having a pair of arms extending away from an upper surface thereof, wherein the pair of arms are angled such that a linear distance between a distal end of each of the pair of arms and a front side of the base is greater than that between the distal end and a rear side of the base. A fastener is disposed on the distal end, wherein the fastener is configured to removably secure to a rung of a ladder. A cutout is disposed within the base along the front side, wherein a platform is hingedly affixed to a lateral side of the cutout. The platform is configured to move between an open position and a closed position, wherein the closed position the platform rests within the cutout such that the platform is coplanar with the base. In some embodiments, an outer edge of the platform is flush with the front side when the platform is in the closed position. In another embodiment, a pair of protrusions extend from opposing ends of the rear side of the base, wherein the pair of protrusions are configured to abut an exterior of a leg of the ladder. In other embodiments, the upper surface comprises textured elements thereon. In yet another embodiment, an upper surface of the platform comprises textured elements thereon. In some embodiments, the fastener is configured to contour to the rung. In another embodiment, the fastener comprises a hook. In other embodiments, a lip is affixed to a lower surface of the base, wherein the lip extends into the cutout and is configured to receive an end of the platform thereon. In yet another embodiment, a rear platform is affixed to the rear side of the base. In some embodiments, the platform comprises a width less than that of the rear platform.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
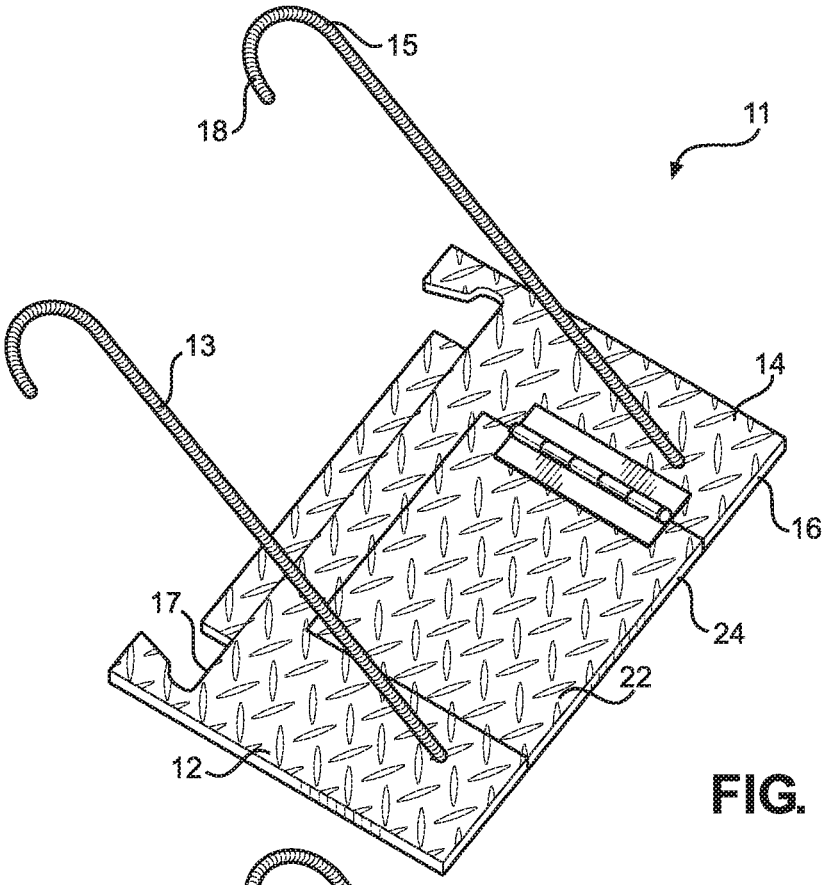
FIG. 1A shows a perspective view of an embodiment of the ladder step attachment in a closed position.

Reference is made herein to the attached drawings. Like reference numerals are used throughout the drawings to depict like or similar elements of the ladder step attachment. The figures are intended for representative purposes only and should not be considered to be limiting in any respect.

Figure 1B:
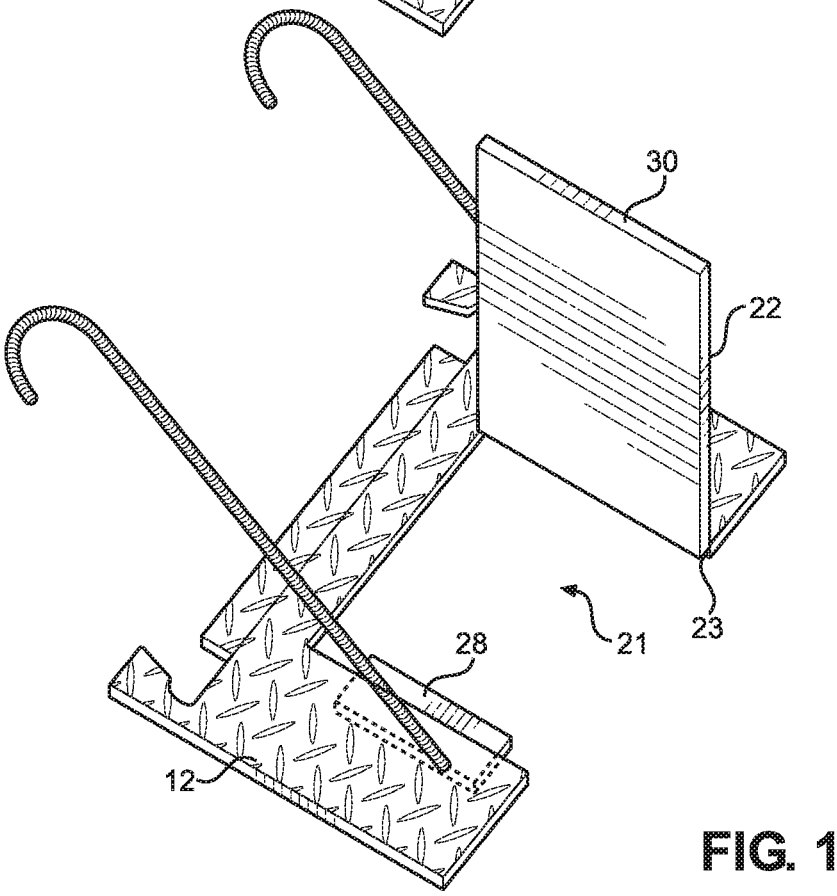
FIG. 1B shows a perspective view of an embodiment of the ladder step attachment in an open position.
Figure 3:
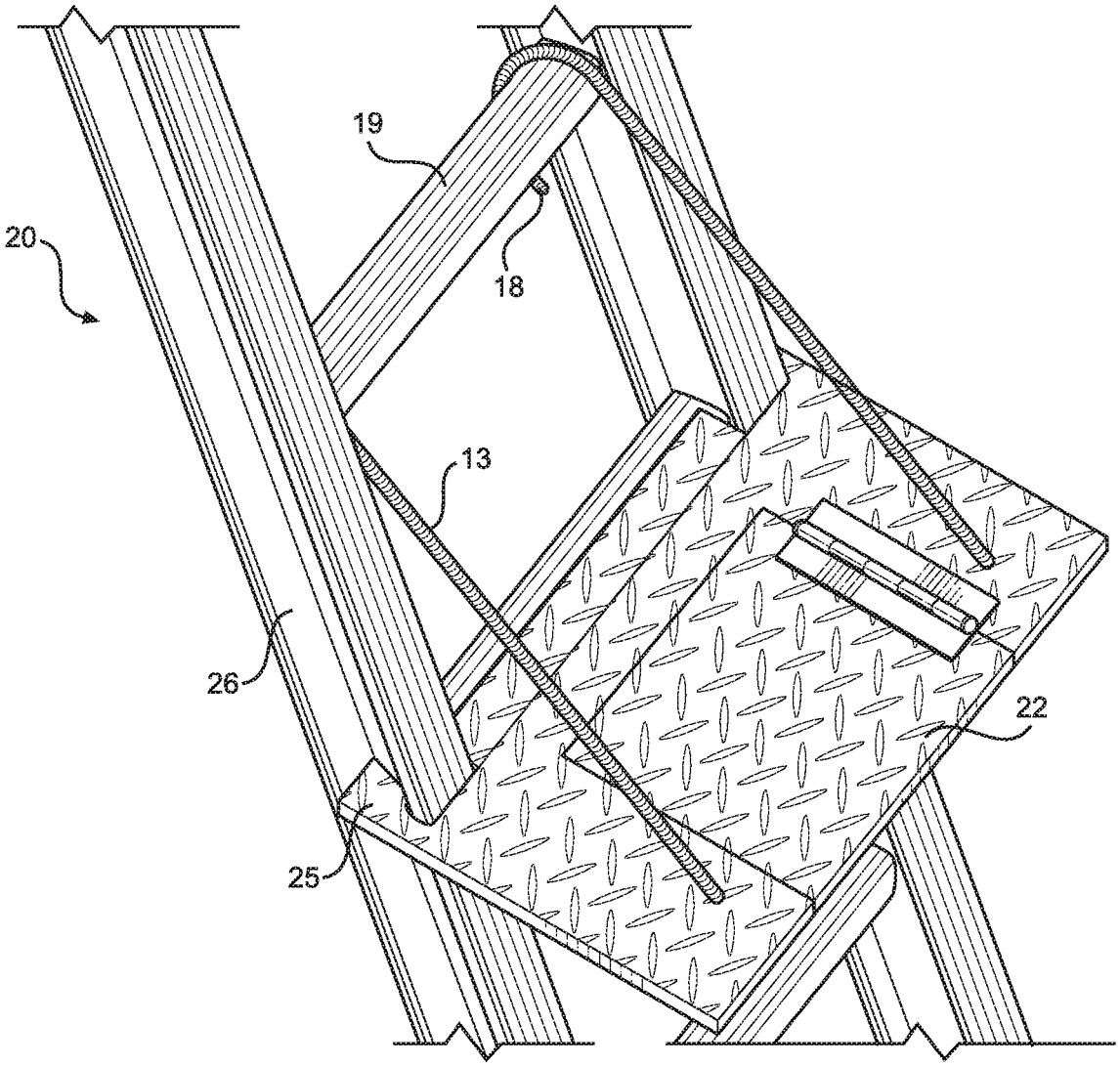
FIG. 3 shows a perspective view of an embodiment of the ladder step attachment affixed to a ladder.

Referring now to FIGS. 1A and 1B, there is shown a perspective view of an embodiment of the ladder step attachment in a closed position and a perspective view of an embodiment of the ladder step attachment in an open position, respectively. The ladder step attachment 11 comprises a base 12 configured to removably secure to a ladder (as shown in FIG. 3, 20) such that the base 12 rests parallel to an upper surface of a rung (as shown in FIG. 3, 19) of the ladder, thereby allowing a user to utilize the base 12 as a step or shelf having an increased surface area than that of the rung. In the illustrated embodiment, the base 12 comprises a width greater than that of the ladder, such that the surface area provided thereby is increased. In this way, the user can move about the base 12 with greater freedom than that provided by a traditional ladder rung. In the illustrated embodiment, the base 12 comprises a substantially rectangular cross-section, however other cross-sections are contemplated in alternate embodiments.

The base 12 further comprises a platform 22 hingedly affixed thereto, wherein the platform 22 is configured to selectively move between an open position (as shown in FIG. 1B) and a closed position (as shown in FIG. 1A). The platform 22 is further configured to rest within a cutout 21 disposed within the base 12 along a front side 16 thereof, such that the platform 22 is coplanar with the base 12 when in the closed position. In the illustrated embodiment, the cutout 21 is dimensioned to receive the platform 22 therein within a close tolerance, such that the base 12 appears continuous when the platform 22 is in the closed position. Furthermore, in the shown embodiment, an outer edge 24 of the platform 22 is flush with the front side 16 of the base 12 when the platform 22 is in the closed position. In this way, the platform 22 does not extend beyond the base 12 providing minimal form factor for ease of transport, while simultaneously minimizing the risk of the platform 22 catching on an object in the surrounding area.

In the illustrated embodiment, the cutout 21 is dimensioned to allow a user to climb therethrough, thereby providing convenience to the user when climbing a ladder having the ladder step attachment 11 attached thereto, as the user is not required to first remove the ladder step attachment 11 before ascending or descending the ladder. In the illustrated embodiment, the base 12 further comprises a lip 28 affixed to a lower surface thereof, wherein the lip 28 is configured to receive an end 30 of the platform 22 thereon when the platform 22 is in the closed position. In this way, the lip 28 retains the platform 22 in a coplanar position relative to the base 12. In the illustrated embodiment, the platform 22 is hingedly affixed to the base 12 along a lateral edge 23 of the cutout 21 opposite the lip 28.

The ladder step attachment 11 further comprises a pair of arms 13 disposed along an upper surface 14 of the base 12. In the illustrated embodiment, the pair of arms 13 are disposed on opposing ends of the platform 22 such that the base 12 is evenly supported thereby. The pair of arms 13 are further angled from the base 12 such that a linear distance between a distal end 15 of the pair of arms 13 and a rear side 17 of the base 12 is less than that between the distal end 15 and the front side 16. In this way, the pair of arms 13 are configured to extend away from the base 12 such that the pair of arms 13 can interact with a rung adjacent to that on which the base 12 is resting. A fastener 18 is affixed to the distal end 15, wherein the fastener 18 is configured to removably secure to a rung of the ladder. In the illustrated embodiment, the fastener 18 is comprises a hook, however, in alternate embodiments, the fastener 18 is configured to contour to the rung, such as via a square bracket for square rungs and the like, such that the fastener 18 is securely affixed thereto via friction fit. In the illustrated embodiment, the pair of arms 13 comprises a plurality of ridges along an exterior surface thereof, wherein the plurality of ridges are configured to provide increased frictional engagement between the user and the pair of arms 13 should the user utilize the pair of arms 13 as a gripping surface.

Figure 2:
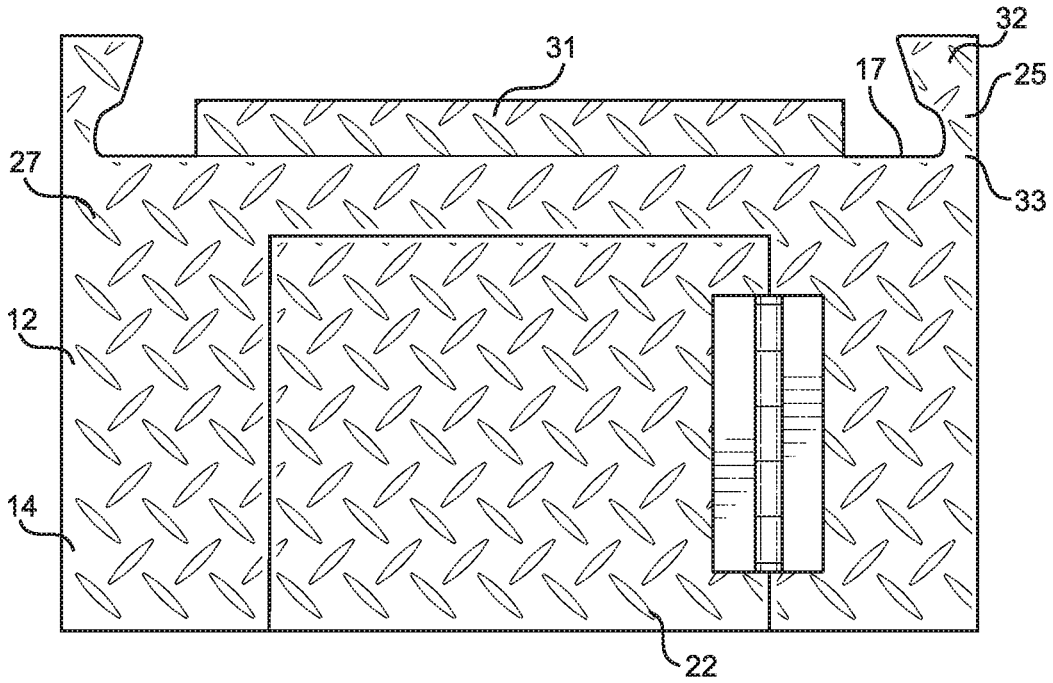
FIG. 2 shows a top plan view of an embodiment of the ladder step attachment.

Referring now to FIG. 2, there is shown a top plan view of an embodiment of the ladder step attachment. In the illustrated embodiment, the base 12 further comprises a plurality of textured elements 27 along an upper surface 14 thereof. The plurality of textured elements 27 are configured to provide an increased surface area for greater frictional engagement between a user and the base 12. In the shown embodiment, the plurality of textured elements 27 are evenly distributed across the entirety of the upper surface 14. Furthermore, the plurality of textured elements 27 are further disposed along the upper surface 14 of the platform 22, thereby ensuring that the user is provided increased stability and support when utilizing the base 12 as a step.

In the illustrated embodiment, a pair of protrusions 25 extend from the rear side 17 of the base 12. The pair of protrusions 25 are configured to abut a leg (as shown in FIG. 3, 26) of the ladder along an exterior side thereof, such that the base 12 is securely affixed thereto. The pair of protrusions 25 are configured to prevent the base 12 from sliding laterally along the ladder when the base 12 is secured thereto. In the illustrated embodiment, the pair of protrusions 25 taper inwardly from an exterior end 32 thereof towards an interior end 33 thereof, such that the exterior end 32 comprises a greater width than the interior end 33. In this way, the pair of protrusions 25 are configured to contour to the leg having a recessed central portion, such that the pair of protrusions 25 are engaged therewith, thereby allowing the base 12 to be stabilized on the ladder.

In the illustrated embodiment, the base 12 further comprises a rear platform 31 extending away from the rear side 17. The rear platform 31 is configured to rest along an upper surface of the rung of the ladder, thereby providing increased support to the base 12. In the shown embodiment, the rear platform 31 comprises a width less than that of the base 12, thereby allowing the base 12 to extend beyond the width of the ladder, while simultaneously having a width greater than that of the platform 22. In some embodiments, the width of the rear platform 31 is dimensioned to match that of the rung, thereby maximizing the support provided thereto. In the illustrated embodiment, the rear platform 31 is rigidly affixed to the base 12 such that the rear platform is coplanar with the base 12, thereby ensuring that the base 12 extends parallel to the upper surface of the rung.

Referring now to FIG. 3, there is shown a perspective view of an embodiment of the ladder step attachment affixed to a ladder. In one exemplary use, the user removably secures the ladder step attachment to the ladder 20 such that the pair of arms 13 are removably secured to the rung 19 adjacent to the rung 19 upon which the base rests via the fastener 18. Each leg 26 of the ladder 20 is secured between the pair of protrusions 25 and the rear platform, thereby ensuring that the ladder support attachment does not laterally shift while in use. In the illustrated embodiment, the leg 26 comprises a recessed central portion, such that the tapered protrusion 25 contours therewith. The rear platform is placed along the upper surface of the rung 19, such that the ladder step attachment is stabilized on the ladder 20 and can support the user's weight thereon. As the width of the base is greater than that provided by the rung 19, the user is provided greater mobility along the ladder step attachment than when using the ladder 20 alone. When ascending or descending the ladder 20 past the rung 19 upon which the ladder step attachment is secured, the user can move the platform 22 to the open position and climb past the ladder step attachment without first removing the ladder step attachment from the ladder 20. In this way, the user is ensured greater efficiency and decreased frustration than when utilizing alternate ladder attachments that must first be removed.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder step attachment, comprising:

a base having a pair of arms extending away from an upper surface thereof;

wherein the pair of arms are angled such that a linear distance between a distal end of each of the pair of arms and a front side of the base is greater than that between the distal end and a rear side of the base;

a fastener disposed on the distal end, wherein the fastener is configured to removably secure to a rung of a ladder;

a cutout disposed within the base along the front side;

a platform hingedly affixed to a lateral side of the cutout, wherein the platform selectively moves between a closed position and an open position;

wherein the platform pivots about an axis substantially perpendicular to the front side of the base;

wherein the closed position, the platform rests within the cutout such that the platform is coplanar with the base;

wherein the pair of arms are affixed to the upper surface on opposing ends of the platform;

a rear platform rigidly affixed to the rear side of the base, such that the rear platform is coplanar with the base;

a pair of protrusions extending from opposing ends of the rear side of the base, wherein the pair of protrusions are coplanar with the base and are configured to each abut an exterior of a leg of the ladder;

wherein an exterior of the leg is defined on a lateral side of the leg opposite the rung, such that the leg is disposed between the one of the pair of protrusions and the rear platform;

wherein the pair of protrusions each taper inwardly from an exterior end thereof towards an interior end thereof, such that a width of the pair of protrusions is greater at the exterior end than at the interior end.

2. The ladder step attachment of claim 1, wherein an outer edge of the platform is flush with the front side when the platform is in the closed position.

3. The ladder step attachment of claim 1, wherein the upper surface comprises textured elements thereon.

4. The ladder step attachment of claim 1, wherein an upper surface of the platform comprises textured elements thereon.

5. The ladder step attachment of claim 1, wherein the fastener is configured to contour to the rung.

6. The ladder step attachment of claim 5, wherein the fastener comprises a hook.

7. The ladder step attachment of claim 1, further comprising a lip affixed to a lower surface of the base, wherein the lip extends into the cutout and is configured to receive an end of the platform thereon.

8. The ladder step attachment of claim 1, wherein the platform comprises a width less than that of the rear platform.

9. The ladder step attachment of claim 8, wherein an entirety of the rear platform comprises a width less than an entirety of the base.

* * * * *